United States Patent [19]

Lapeyre

[11] Patent Number: 4,566,408

[45] Date of Patent: Jan. 28, 1986

[54] INTERNAL COMBUSTION ENGINE

[76] Inventor: James M. Lapeyre, 13 Richmond Pl., New Orleans, La. 70151

[21] Appl. No.: 237,667

[22] Filed: Feb. 24, 1981

Related U.S. Application Data

[63] Continuation of Ser. No. 97,955, Nov. 28, 1979, abandoned, which is a continuation of Ser. No. 890,980, Mar. 28, 1978, abandoned.

[51] Int. Cl.[4] ..... F02B 25/08

[52] U.S. Cl. ..... 123/51 B; 123/51 BB; 123/51 BD; 123/54 A; 123/74 A; 123/293

[58] Field of Search ..... 123/51 R, 51 B, 51 BD

[56] References Cited

U.S. PATENT DOCUMENTS 657,226 9/1900 Marmonier ..... 123/51 B

FOREIGN PATENT DOCUMENTS 0019677 of 1913 United Kingdom ..... 123/51 B
0483063 7/1936 United Kingdom ..... 123/51 B

*Primary Examiner*—Craig R. Feinberg
*Attorney, Agent, or Firm*—Wilkinson, Mawhinney & Theibault

[57] ABSTRACT

The present disclosure relates to internal combustion engines of the kind comprising two working cylinders arranged in vertical side-by-side parallel relationship, there being two oppositely working pistons in each cylinder, and the movement of the four pistons being transmitted to a common drive shaft between the cylinders. The top pistons in each cylinder are connected to piston rods which in turn are secured to a crosshead and which crosshead has a pivotal connection for a connecting rod the other end of which is connected to drive a drive shaft. The lower or bottom two pistons are in like manner connected through a crosshead to the drive shaft. Fuel injection occurs at the mid-point of each cylinder between each of the two pistons in each cylinder. As to each cylinder intake air is ported in above the injector and exhaust air is ported out beneath the injector. The angular spacing of the cranks on the crankshaft is such that the intake controlling pistons, being the upper one in each cylinder will be forced to lag behind the exhaust controlling piston, being the lower one in each cylinder, in such a manner that the exhaust porting is forced to open prior to the opening of the intake porting and said exhaust porting is forced to close prior to the closing of the intake porting.

4 Claims, 7 Drawing Figures

INTERNAL COMBUSTION ENGINE

This is a continuation of application Ser. No. 097,955, filed 11-28-79, now abandoned, which is a continuation of application Ser. No. 890,980, filed 3-28-78, now abandoned.

THE PRIOR ART

The best prior art on the above described type of multiple cylinder opposed piston engines known to me as of the filing of this application are as follows:

British Pat. No. 10,981, of 1908;

U.S. Pat. No. 2,203,648, June 4, 1940;

U.S. Pat. No. 2,129,172, Sept. 6, 1938.

The best prior art of the single cylinder opposed piston prior engines are:

U.S. Pat. No. 1,629,878, May 24, 1927;

U.S. Pat. No. 2,159,197, May 23, 1939;

U.S. Pat. No. 1,679,976, Aug. 7, 1928.

An object of the present invention is to eliminate valves and cam shafts.

Another object is to eliminate high pressure gaskets.

Another object is to provide a geometry which permits tensile stresses only on the connecting rods thereby permitting reduction in weight of the connecting rods.

Another object of the present invention is to provide an engine geometry which permits the use of the linear motion derived from the movement of the pistons to be used directly for engine fuel pumping battery charging, such pumping would include lubrication, oil pumping, fuel pumping, water pumping, and the generation could be AC convertible to DC for battery charging.

Another object of the invention is to provide an engine without tappet or poppet valves which is superchargable.

A further object of the present invention is to have forced intake and pressurized scavenging air.

A still further object is to provide an engine geometry that permits combustion chamber blow down prior to opening of the intake port.

A further object of the present invention is to provide an engine which permits of easy air compression without exterior mechanisms and which provides an engine which minimizes the use of gears, belts, pulleys, chains, etc.

Another object is to provide an engine with reduced noise generation, no cam shaft, no noise, no generator bearing, no noise, no water pump bearing noise, no fuel pump bearing noise, no lubricating pump bearing noise and with minimal piston slap, possibly even zero piston slap.

A further object of the invention is to provide an engine having simplified fuel injection timing, in other words fuel is injected into a common precombustion chamber which serves two combustion cylinders simultaneously even though the power is extracted from the cylinders at 180° or approximately 180° on the crankshaft. The injection takes place at once, not once at zero and again at 180°.

The present invention provides a simple means of guaranteeing that the exhaust port always opens first and always closes first thereby permitting as mentioned before natural blow down of the combustion chamber then positive high pressure scavenging of fresh air of the combustion chamber followed by supercharging combustion chamber due to the fact that the intake is still open and being fed with air after the exhaust port is closed.

Another object of the invention is to provide an engine having a variable compression ratio so that the engine may be started while cold at a relatively high compression ratio, or at highest compression ratio, and reduced for operation to a lower compression ratio and which is of light weight.

A further object of the invention is to provide an engine having lateral symmetry, in other words everything that happens on one side of the crankshaft happens on the other side of the crankshaft and happens simultaneously and which provides an engine which delivers a fixed measured quantity of air to the combustion chambers for scavenging and supercharging regardless of engine speed.

Another object of the invention is to provide an engine having the fewest number of bearings and the greatest possible power to weight ratio.

The present invention provides a diesel engine having few moving parts. By reducing the number of moving parts, the engine can be made more cost effective, lighter in weight, simpler to manufacture and service, and the source of fewer noises.

This invention provides a two cycle diesel engine whose basic construction is of 2 parallel cylinders, each containing 2 opposed pistons sharing one set of connecting rods (three singles or one forked and one plain), and a single crankshaft. Two cycle engines offer better power to weight ratio than does a 4 cycle. The 2 cylinders provide for an engine which is symmetrically balanced about the crankshaft, and opposed pistons eliminate the need for cylinder heads and gaskets. The opposed piston arrangement are inherently balanced. The elimination of cylinder heads provides for better thermal efficiency, and the elimination of gaskets permit higher operating cylinder pressures with less increase in weight.

The present invention provides a two cycle diesel engine which is optionally superchargable but without the need for intake or exahust valves, camshaft, valve actuators, valve springs and timing chains. Having an engine which is superchargable clearly improves the power to weight ratio, clearly reduces the emission of pollutants, and the elimination of valves and their related machinery makes for a simpler engine which reduces both manufacturing and service cost, and completely eliminates all of the noise associated with valves and their driving mechanism.

This invention provides an engine which is optionally positively self supercharging without the addition of external blowers or pumps and without the addition of more connecting rods or external levers etc. The positive nature of the supercharging guarantees that a known volume of air is forced through and into the cylinders regardless of engine speed, and the elimination of external blowers or air pumps reduces manufacturing cost and service costs.

This invention provides a two cycle diesel engine which may optionally have a combustion chamber arrangement which is common to both cylinders and which therefore simplifies fuel injection timing and which to a large extent ensures an equalization of pressures in both cylinders. This arrangement makes for a better balancing of the torque inputs to the crankshaft and for a smoother running, less noisy engine.

A still further object of the present invention is to provide an engine which may optionally have a variable compression ratio by providing the aforesaid common combustion chamber with means by which the volume of the compression chamber can be varied depending upon the loading of the engine thereby controlling maximum pressures permitted to develop in the cylinders. This feature clearly aids in the starting of cold engines since they may be started at high compression ratio and run under-load or partial load at low compression ratios. This feature also will help to improve the power to displacement ratio and will improve the emission of pollutants, primarily oxides or nitrogen which are produced when cylinder pressures and therefore temperatures exceed a desired level.

Many opposed piston engines have been built over the years and many have been highly successful and have proved the efficacy of the opposed piston arrangement. The novelty of the engine of the present invention however, is that is eliminates both the intake and exhaust valves and uses oppossed pistons in a minimum of 2 cylinders each having a single combustion chamber and which are parallel and by providing a bridging means from the pistons in one cylinder to the pistons in the second cylinder, a symmetrical and balanced geometry arises which permits great simplification in connecting the pistons to the crankshaft as is evident from the drawings.

With the foregoing and other objects in view the invention will be more fully described hereinafter and more particularly pointed out in the appended claims.

In the drawings in which like parts are denoted by reference characters throughout the several views.

Figure 1:
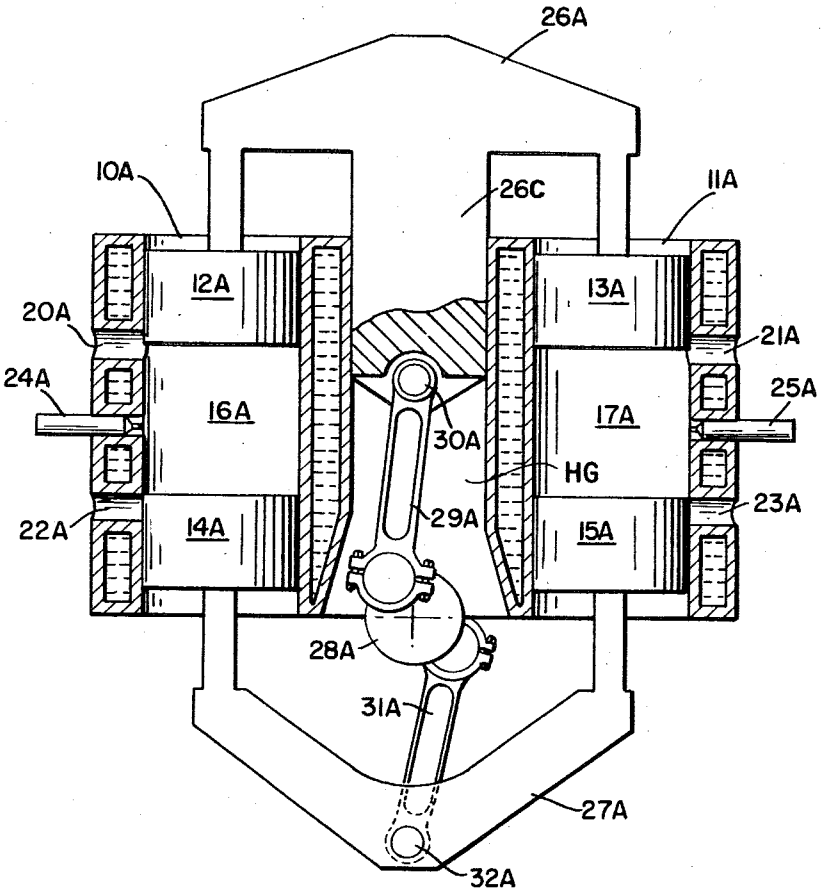
FIG. 1 is a vertical sectional view through an embodiment of my multiple cylinder opposed piston two cycle engine in which the crankshaft centerline is postioned co-planar with the plane of one pair of ends of the two cylinders.

Referring now to FIG. 1, a form of engine is shown as having cylinders 10A, 11A, having single ended intake controlling pistons 12A, 13A secured to a piston bridging means 26A having a vertical slide member 26C. A pair of single ended exhaust controlling pistons 14A, 15A are secured to a piston bridging means 27A. Each cylinder has air intake ports 20A, 21A at their upper portion and exhaust ports 22A, 23A at their lower portion, the fuel injectors 24A, 25A lying therebetween. In this embodiment the crankshaft 28A has its centerline positioned co-planar with the plane of one pair of ends of the two cylinders 10A, 11A.

In this embodiment the crankshaft 28A is connected through connecting rods 29A, 31A which are pivotally connected to the piston bridging means 26A, 27A at pivots 30A, 32A. As shown, both the vertical slide member 26C and connecting rod 29A reciprocate in the hollow guideway H.G. lying between cylinders 10A and 11A.

Figure 2:
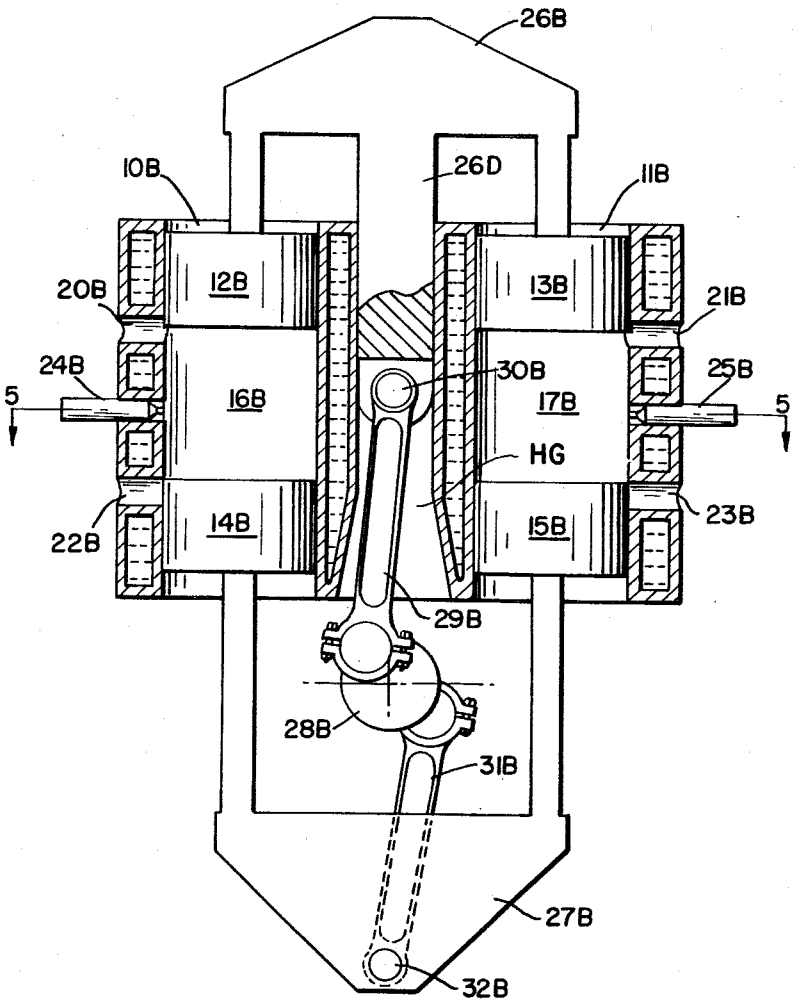
FIG. 2 is a vertical section through another embodiment of my invention with the centerline of the crankshaft lying below the bottom of one pair of ends of the two cylinders.
Figure 3:
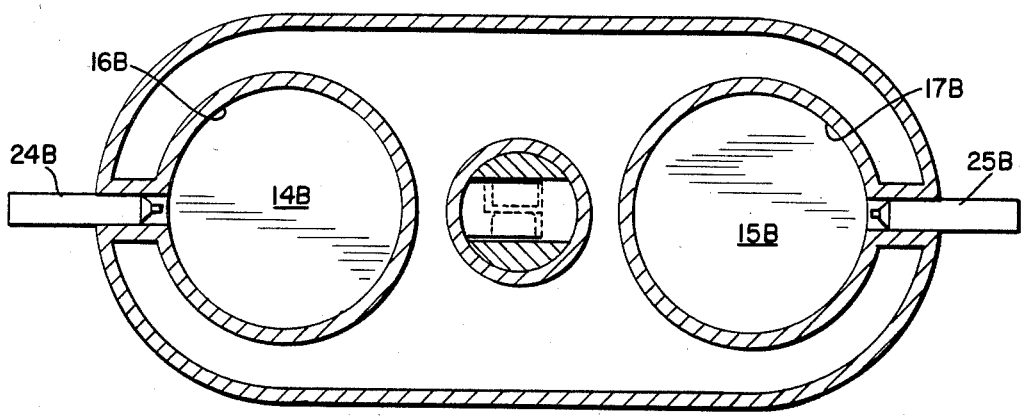
FIG. 3 is a horizontal section taken on the line 4—4 in FIG. 2.

Referring now to FIGS. 2 and 3, another modified form of engine is shown as having cylinders 10B, 11B, having single ended intake controlling pistons 12B, 13B secured to a piston bridging means 26C having a vertical slide member 26D. A pair of single ended exhaust controlling pistons 14B, 15B are secured to a piston bridging means 27B. Each cylinder has air intake ports 20B, 21B at their upper portion and exhaust ports 22B, 23B at their lower portion, the fuel injectors 24B, 25B lying therebetween. In this embodiment the crankshaft 28B has its centerline positioned outside the space defined by the planes of said cylinder ends. The crankshaft 28B is connected through connecting rods 29B, 31B which are pivtoally connected to the piston bridging mens 26B, 27B a pivots 30B, 32B, and in a manner similar to that shown in FIG. 3 both vertical slide member 26D and connecting rod 29B reciprocate in the hollow guideway H.G. laying between cylinder 10B and 11B.

Figure 4:
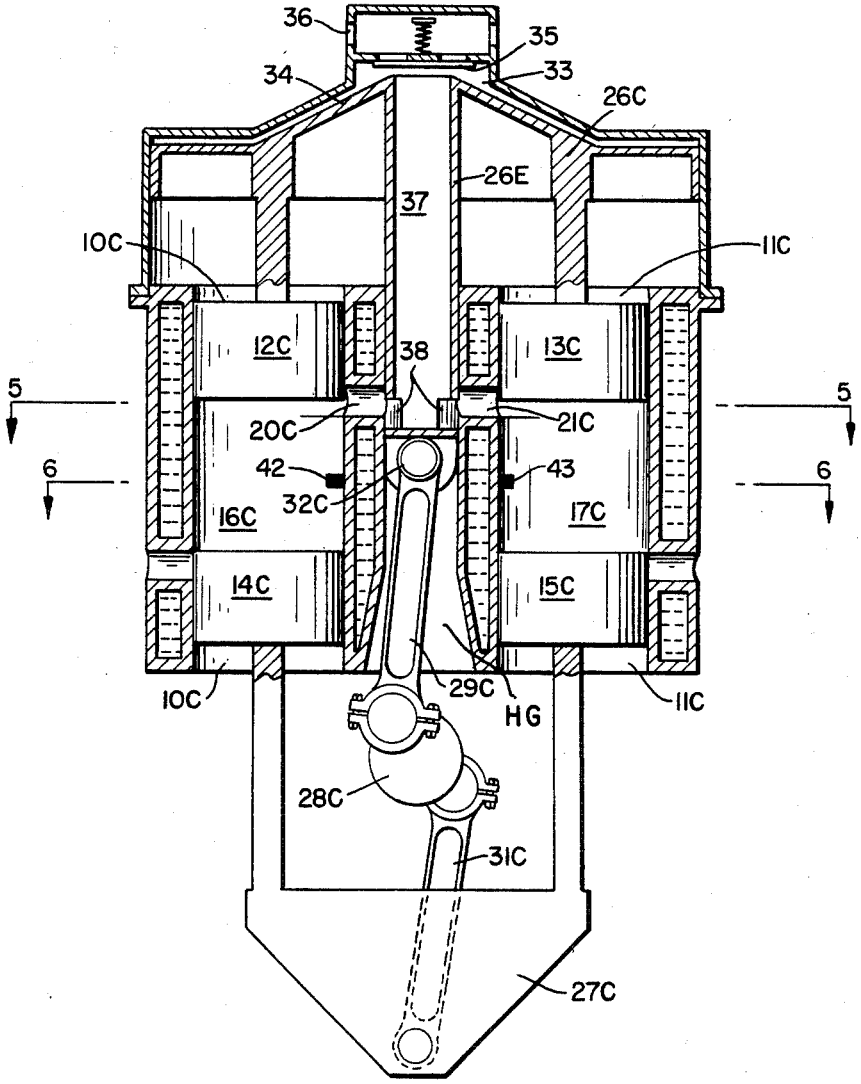
FIG. 4 is a vertical section through another embodiment of my invention having an air compressor piston at the top of the cylinders having an air manifold between the two cylinders and communicating intake air to both cylinders.
Figure 5:
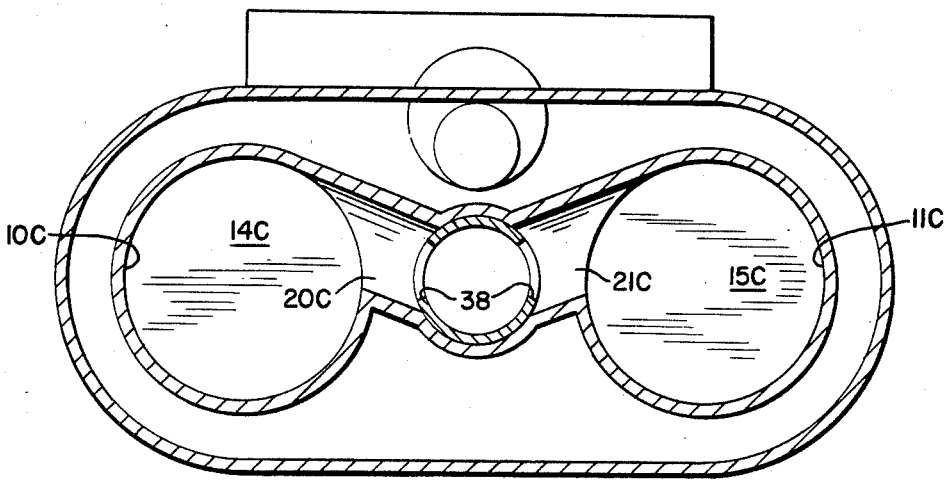
FIG. 5 is a horizontal section taken on the line 5—5 in FIG. 4.

Referring now to FIGS. 4, 5 and 8, a further modification of my engine is shown as having a pair of vertically positioned cylinders 10C, 11C horizontally displaced. The upper part of each cylinder has single ended intake controlling pistons 12C, 13C secured to a piston bridging means 26C having a vertical slide member 26E which operates an air compressor 33 which pumps air through air intake ports 20C, 21C into the combustion chambers 16C, 17C. Positioned in the lower portion of cylinders 10C, 11C are exhaust port controlling pistons 14C, 15C which are connected to the piston bridging means 27C through the open ends of the cylinders 10C, 11C. As the air compressor piston 34 goes down valve 35 opens and admits air through port 36. When the air compressor piston goes up, valve 35 seats and air is forced down hollow shaft 37 through air delivery ports 38 into the cylinder air intake ports 20C, 21C. In this embodiment the crankshaft 28C lies between the parallel axes of the two cylinders 10C and 11C, and is driven by connecting rods 29C, 31C, rod 31C being pivotally connected to piston bridging means 27C while rod 29C is connected pivotally at 32C to the base of the hollow shaft 37. The shaft 37 reciprocates within a hollow guideway H.G. each time the air intake pistons 12C, 13C reciprocates as does air compressor piston 34.

Figure 6:
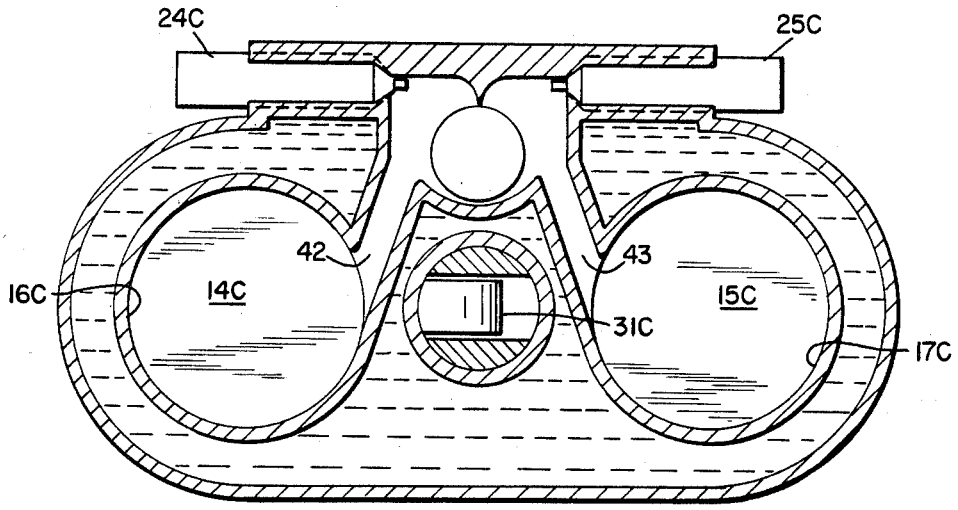
FIG. 6 is a horizontal section taken on the line 6—6 in FIG. 4.

As shown in FIG. 6 the fuel injectors 24C, 25C are positioned to inject fuel into a precombustion chamber PC common to combustion chambers 16C and 17C positioned midway in cylinders 10C and 11C and connected to said combustion chambers through ducts 42 and 43.

Figure 7:
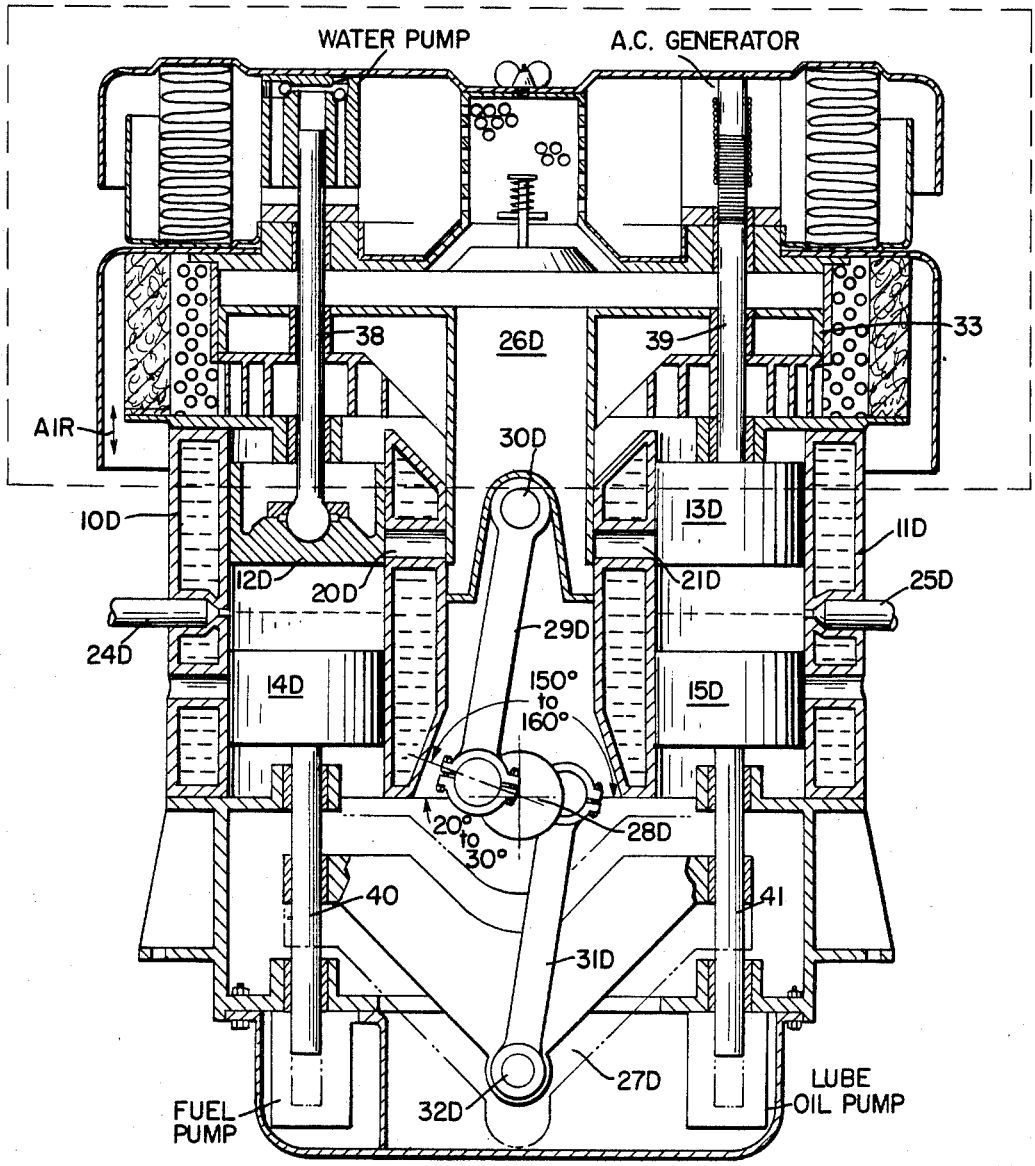
FIG. 7 is a vertical section taken through a further modified form of my engine similar to FIG. 4 including guide means for the piston bridging means to minimize lateral movement of both the piston bridging means as well as lateral movement of said pistons.

Referring now to FIG. 7, a pair of spaced apart cylinders 10D, 11D have air intake control pistons 12D, 13D in their upper portion and exhaust port controlling pistons 14D, 15D in their lower portion. Fuel injectors 24D, 25D are positioned between the air intake and exhaust ports. In this embodiment the piston bridging means 26D is substantially T-shaped. The leg of the T is pivotally connected to a connecting rod 29D at tis upper end at pivot 30D and the leg of the T is hollow to provide an air delivery manifold to supply pressurized air from the compressor 33 to the air intake openings 20D, 21D. The pistons 12D, 13D are secured to the top or cross member of the T-shaped piston bridging means by guide means 38, 39.

The lower pistons 14D, 15D which control exhuast ports are secured to the lower piston bridging means 37D by guide means 40, 41.

The crankshaft 28D is driven by connecting rods 29D, 31D which are pivotally connected to the piston bridging means 26D, 27D, at 30D, 32D.

What I claim is:

1. A two cycle internal combustion diesel engine comprising in combination:

(a) a minimum of two side by side spaced apart axially parallel cylinders, (b) a hollow guideway positioned between, parallel to and axially coplanar with said spaced apart cylinders, (c) one variable volume combustion chamber contained within each of said cylinders, (d) air intake porting located in each cylinder wall at a first end of said combustion chamber, (e) air compressing means in communication with said porting for simultaneously forcing air into each of said combustion chambers via said air intake porting, (f) exhaust porting located in each cylinder wall at a second end of said combustion chamber, (g) means for delivering fuel into said cylinders approximately midway of the length of said combustion chamber, when said combustion chamber is at its approximate minimum volume, said means including a pre-combustion chamber common to and in communication with said combustion chamber of each of said cylinders, said pre-combustion chamber being positioned outside of the plane of the axes of said cylinders, (h) one cylindrical single headed pressure sealing valveless air intake controlling piston coaxial with and slidably mounted within each of said cylinders, said piston having its head end facing the combustion chamber and its connector end facing a first non-combustion end of said cylinder, said piston being adapted to open and close said air intake porting as it slides past said air intake porting, (i) a rigid non-pivotal piston bridging means spanning from piston axis to piston axis of said air intake controlling pistons, (j) dual rigid and operationally non-pivotal piston connector means extending from said piston bridging means, said piston connector means being adapted to link said piston bridging means with said air intake controlling pistons at said pistons' connector ends, (k) bridge guide means extending from said piston bridging means into said hollow guideway, said bridge guide means terminating in a connecting rod pivot means, (l) one cylindrical single headed pressure sealing valveless exhaust controlling piston coaxial with and slidably mounted within each of said cylinders, said piston having its head end facing said combustion chamber and its connector end facing a second non-combustion end of said cylinder, said piston being adapted to open and close said exhaust porting as it slides past said exhaust porting, (m) a second rigid non-pivotal piston bridging means spanning from piston axis to piston axis of said exhaust controlling pistons, (n) second dual rigid and operationally non-pivotal connector means extending from said second piston bridging means, said second piston connector means being adapted to link said second piston bridging means with said exhaust controlling pistons at said pistons' connector ends, (o) a single crankshaft located between said parallel axes of said cylinders and between the two piston bridging means, the axis of said crankshaft being at right angles to the plane of said cylinders' parallel axis, (p) at least two connecting rods between the two piston bridging means, one of said connecting rods being connected to pivot means of said bridge guide means and to said crankshaft, and a second connecting rod connected to said second piston bridging means and to said crankshaft, (q) said connections to said crankshaft being made to angularly spaced cranks carried by said single crankshaft, said angular spacing of said cranks being such that as the crankshaft rotates through 360°, the two piston bridging means and their respectively connected pistons are forced to move in opposite directions, the two air intake controlling pistons being reciprocated n unison and the two exhaust controlling pistons likewise being reciprocated in unison and wherein said air intake controlling pistons are forced to lag behind said exhaust controlling pistons in such a manner that said exhaust porting is forced to open prior to the opening of said air intake porting and said exhaust porting is forced to close prior to the closing of said air intake porting.

2. A two cycle internal combustion diesel engine comprising in combination:

(a) minimum of two side by side spaced apart axially parallel cylinders, (b) a hollow guideway parallel to and positioned between said cylinders, (c) one variable volume combustion chamber, (d) air intake porting located in each cylinder wall at a first end of said combustion chamber, having an upstream end and a downstream end, (e) exhaust porting located in each cylinder wall at a second end of said combustion chamber, (f) means for delivering fuel into said cylinders approximately midway of the length of said combustion chamber, and when said combustion chamber is at its approximate minimum volume, said means including a pre-combustion chamber common to and in communication with said combustion chamber of each of said cylinders, said pre-combustion chamber being positioned outside of the plane of the axes of said cylinders, (g) one cylindrical single headed pressure sealing valveless air intake controlling piston coaxial with and slidably mounted within each of said cylinders, said piston having its head end facing the combustion chamber and its connector end facing a first non-combustion end of said cylinder, said piston opening and closing said downstream end of said air intake porting as it slides past said air intake porting, (h) a rigid non-pivotal piston bridging means spanning from pistion axis to piston axis of said air intake controlling pistons, (i) dual rigid and operationally non-pivotal piston connector means extending from said piston bridging means, said piston connector means being adapted to link said piston bridging means with said air intake controlling pistons at said pistons' connector ends, (j) bridge guide means extending from said piston bridging means into said hollow guideway for opening and closing said upstream end of said air intake porting as it slides past said air intake porting, said bridge guide means terminating in a connecting rod pivot means, (k) one cylindrical single headed pressure sealing valveless exhaust controlling piston coaxial with and slidably mounted within each of said cylinders, said piston having its head end facing said combustion chamber and its connector ends facing a second non-combustion end of said cylinder, said piston opening and closing said exhaust porting as it slides past said exhaust porting, (l) a second rigid non-pivotal piston bridging means spanning from piston axis to piston axis of said exhaust controlling pistons, (m) second dual rigid and operationally non-pivotal connector means extending from said second piston bridging means, said second piston connector means being adapted to link said second piston bridging means with said exhaust controlling pistons at said pistons' connector ends, (n) a single crankshaft located between said parallel axes of said cylinders and between the two piston bridging means, the axis of said crankshaft being at right angles to the plane of said cylinders' parallel axis, (o) at least two connecting rods between the two piston bridging means, one of said connecting rods being connected to pivot means of said bridge guide means and to said crankshaft and a second connecting rod connected to said second piston bridging means and to said crankshaft, (p) said connections to said crankshaft being made to angularly spaced cranks carried by said single crankshaft, said angular spacing of said cranks being such that as the crankshaft rotates through 360°, the two piston bridging means and their respectively connected pistons are forced to move in opposite directions, the two air intake controlling pistons being reciprocated in unison and the two exhaust controlling pistons likewise being receiprocated in unison and wherein said air intake controlling pistons are forced to lag behind said exhaust controlling pistons in such a manner that said exhaust porting is forced to open prior to the opening of said air intake porting and said exhaust porting is forced to close prior to the closing of said air intake porting.

3. The engine of claim 2 wherein the location of said single crankshaft axial centerline is between the two piston bridging means and outside the space defined by the planes of said cylinders' end.

4. The engine of claim 2 further comprising at least one air compressing means adapted to deliver compressed air simultaneously to said combustion chambers via said air intake porting.

* * * * *